United States Patent [19]

Tarassoff

[11] Patent Number: 4,712,486

[45] Date of Patent: Dec. 15, 1987

[54] AERIAL ROPEWAY TRANSPORT INSTALLATION WITH THE ROPE STOPPING TO DETACH THE CARS IN THE TERMINAL

[75] Inventor: Serge Tarassoff, Seyssinet, France

[73] Assignee: Pomagalski S.A., Fontaine, France

[21] Appl. No.: 870,414

[22] Filed: Jun. 4, 1986

[30] Foreign Application Priority Data

Jun. 14, 1985 [FR] France ..... 85 09588

[51] Int. Cl.[4] ..... B61B 1/00; B61B 11/00

[52] U.S. Cl. ..... 104/173.1; 104/27; 104/117.1; 104/205; 104/252

[58] Field of Search ..... 104/173.1, 173.2, 27, 104/28, 30, 112, 117.1, 204, 205, 211, 224, 250, 252

[56] References Cited

U.S. PATENT DOCUMENTS

| | | | |
|---|---|---|---|
| 1,429,888 | 9/1922 | Lamb | 104/117.1 |
| 1,959,468 | 5/1934 | Frost et al. | 104/224 |
| 3,871,303 | 3/1975 | Woodling | 104/173.1 |
| 4,050,385 | 9/1977 | Gurr et al. | 104/173.2 |
| 4,473,011 | 9/1984 | Wuschek | 104/112 X |
| 4,509,430 | 4/1985 | Creissels | 104/112 X |
| 4,515,085 | 5/1985 | Rohrbach | 104/250 |

FOREIGN PATENT DOCUMENTS

| | | | |
|---|---|---|---|
| 0015581 | 9/1980 | European Pat. Off. | 104/173 R |
| 0114129 | 7/1984 | European Pat. Off. . | |
| 0125967 | 11/1984 | European Pat. Off. | 104/173 ST |
| 848721 | 11/1939 | France . | |
| 2453062 | 12/1980 | France | 104/173 R |
| 2528781 | 6/1982 | France . | |
| 2504480 | 11/1982 | France | 104/173 R |
| 0192742 | 11/1937 | Switzerland | 104/173 R |
| 248483 | 3/1926 | United Kingdom . | |

*Primary Examiner*—Randolph A. Reese
*Assistant Examiner*—Scott H. Werny
*Attorney, Agent, or Firm*—Parkhurst & Oliff

[57] ABSTRACT

An aerial ropeway transport installation comprises cars coupled to the rope by detachable grips. On the line the cars run in groups but are widely spaced in order to spread the load. In the terminal the cars are uncoupled from the rope at a corresponding location of a platform by an individual control device, the cars of any one group stopping one behind the other. The rope speed is temporarily slowed down or stopped during each detachment and/or attachment operation.

6 Claims, 6 Drawing Figures

Fig. 1
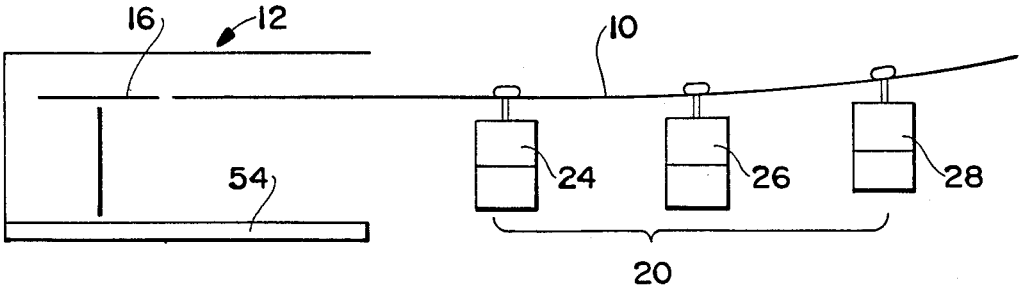
Fig. 2
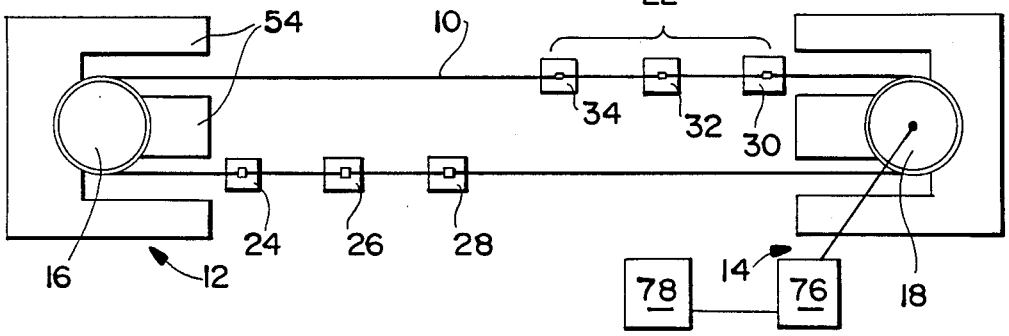
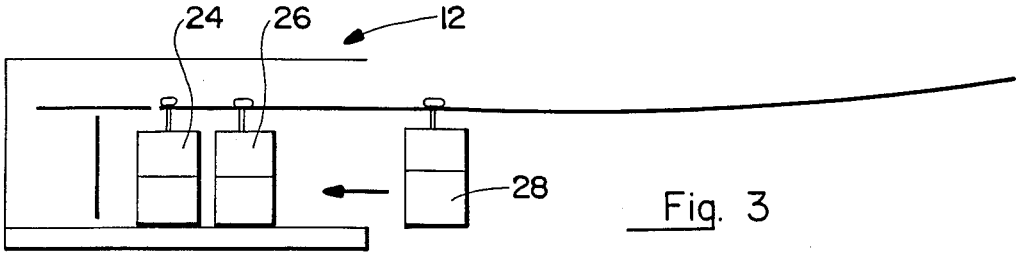
Fig. 3
Fig. 4
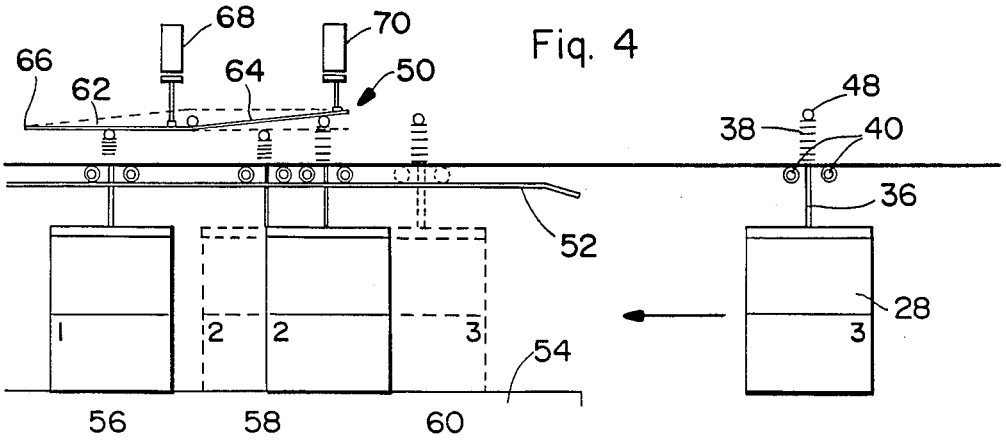

AERIAL ROPEWAY TRANSPORT INSTALLATION WITH THE ROPE STOPPING TO DETACH THE CARS IN THE TERMINAL

BACKGROUND OF THE INVENTION

The invention relates to an aerial ropeway transport installation having a hauling or carrier-hauling rope extending between two terminal stations and driven with a running movement, and cars, trucks, chairs or suchlike, coupled to said rope on the line by detachable grips enabling uncoupling to take place in the terminal stations for the passengers to be loaded and unloaded at a standstill.

An installation of the pulsed type is known which comprises, instead of the conventional high-capacity cable-car transporter, a set of cars, spaced out along the rope, in order to spread the load on the rope more evenly. When the set of cars enters the station, the drive rope is slowed down or stopped for the passengers to be loaded or unloaded. The length of the set of cars depends on the spacing of the cars and when the latter are widely spaced, in order to spread the load more evenly, the slowing down time and/or the length of the platform receiving the cars are great.

A conventional cable-car, with cars evenly spaced out along the rope on the line and detached from the rope in the terminals, enables the cars to be brought closer together in the terminals, and the length of the platforms to be reduced, but requires an elaborate device to detach the cars and attach them on a rope running at high speed and to transfer the cars in the terminal. Devices of this kind are costly and delicate to operate.

SUMMARY OF THE INVENTION

The object of the present invention is to provide a new type of transporter in which the vehicles or cars are spaced out along the rope and uncoupled from the rope in the terminals, the rope being stopped or almost stopped during the attachment and detachment operations.

The installation according to the invention comprises in each terminal a detachment and/or attachment area of said car grips, said cars being fitted with control means of said grips, to stop each car at a location of an unloading and/or loading platform. A device controlling the speed of the drive motor of said rope slows down and almost or completely stops the rope running each time a car grip is attached or detached, and speeds the rope up again until the attachment or detachment operation of the grip of the following car, which stops alongside said platform.

The installation may be of the single-rope, double-rope or multiple-rope kind and comprise cars, trucks or chairs to transport passengers or materials, the term car being used hereinafter. On the line the cars are advantageously grouped together in a set or group, maintaining sufficient space between successive cars to spread the loads. Each terminal comprises in this case a platform which can accommodate all the cars of a group at a standstill a small distance apart alongside the platform. The first car of the group stops at the end of the platform, its grip having being moved into the detachment position from the rope by a control device, for instance a rail or a control flap, fitted at the end of the platform. The second car stops behind the first one, its grip having been detached by a corresponding control rail, fitted at this location, and so on. Each car of the group has a corresponding platform location and this location is fitted with a device controlling the grip of the corresponding car. It is clear that this control device, for example that of the second car, must not cause the first car to be detached when it passes and this individualization can be achieved in various ways, for example by lateral staggering of the rails and grip control levers or according to a preferred embodiment, by control or positioning of the control rail at the appropriate moment, notably in the above-mentioned case after the first car has passed and before the second one arrives. This sequential control may be mechanical, hydraulic or electrical and comprise car passage detectors and counters.

The rope drive speed is reduced or almost nil each time a car grip is attached or detached. This results in an appreciable simplification of the detachment and re-attachment devices, without wasting too much time, the rope being reaccelerated as soon as the operation has been completed until the next car in the group arrives. This reacceleration allows the cars to be large distances apart, for example more than 10 meters and notably 15 meters, without an appreciable decrease in the carrying capacity. The rope can of course be stopped, but a speed of less than 1 m/sec, for example 0.3 m/sec, is sufficient for satisfactory operation.

The detachment control can be used for re-attachment of the cars respecting once more the order of the cars. The departures are staggered, by time-lagging of the attachment controls, so that the spacings of the cars of any one group are maintained on the line. Slowing the rope down makes attachment easier and at the above-mentioned speed the grip at a standstill can be closed directly on the rope without the car being accelerated beforehand.

The invention is particularly well suited to to-and-fro running of groups of cars on one or two tracks, but can be used with a continuous running system, the cars being transferred in the terminal from one track to the other by any operative system. In a simplified installation, each group comprises a single car, this car being for example moved before the next car arrives on the platform.

In the case of a to-and-fro system, the rope is stopped when the last car of the group reaches the platform and this car can remain coupled to the rope, which simplifies the installation.

BRIEF DESCRIPTION OF THE DRAWINGS

Other advantages and characteristics will become more clearly apparent from the following description of an embodiment of the invention, given as an example only and represented by the accompanying drawings, in which:

FIG. 1 is a schematic elevational view of one end of a transport installation according to the invention, with the cars represented on the line;

FIG. 2 is a reduced scale plan view of the installation according to FIG. 1;

FIG. 3 is a similar view to that of FIG. 1, with the cars represented on entering the terminal;

FIG. 4 is a detailed view of FIG. 3, on an enlarged scale, showing the grip detachment mechanism;

DETAILED DESCRIPTION OF THE PREFERRED EMBODIMENTS

Figure 5:
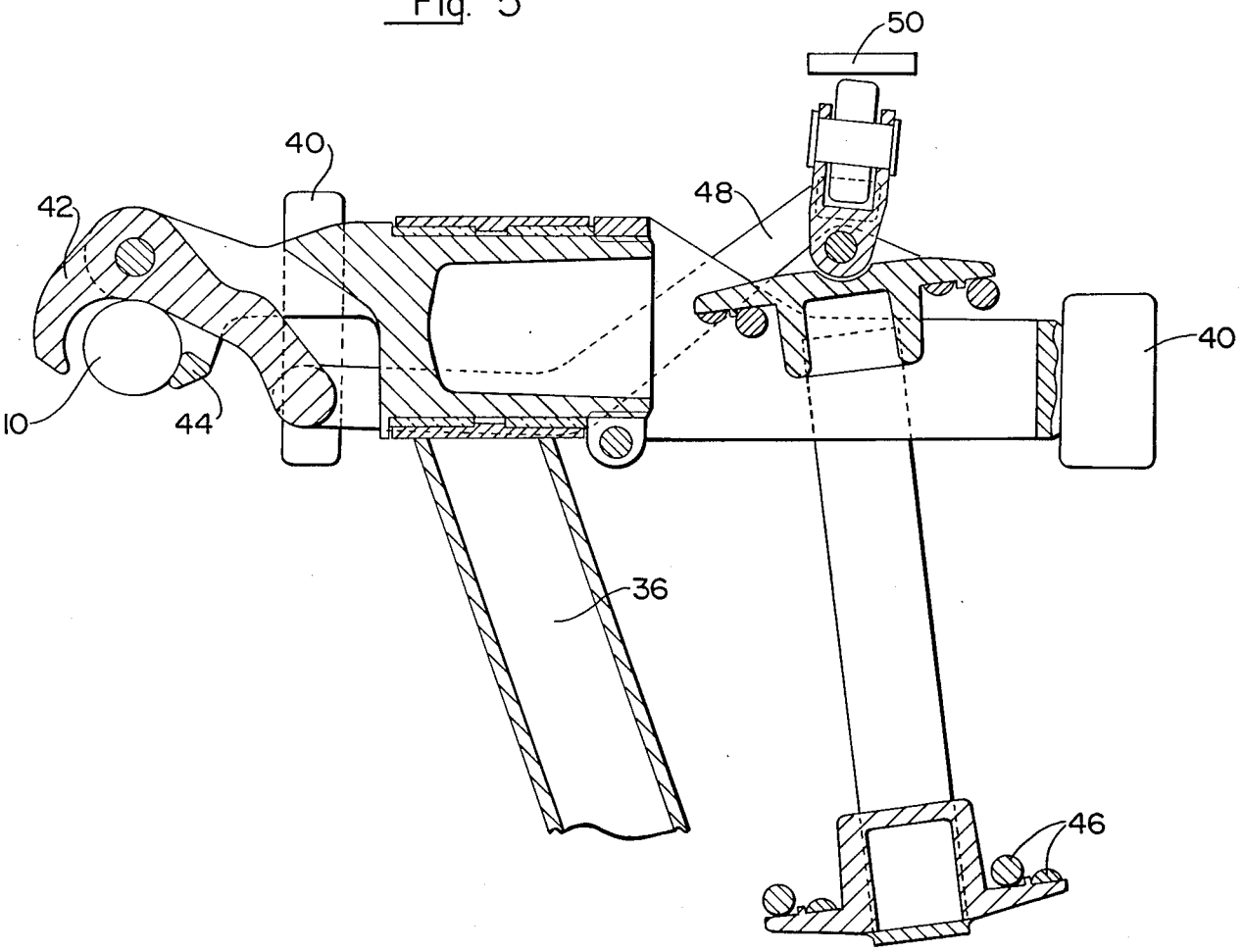
FIG. 5 is a cross-sectional view of a grip.

The invention is hereafter described as being applied to a to-and-fro transporter having a carrier-hauling rope supporting the cars, but it may also be used for trucks or chairs and comprise several carrier-hauling ropes or carrier ropes and hauling ropes. Operation may be continuous.

In the figures, a cable-car with to-and-fro running comprises a carrier-hauling rope 10 extending in a closed loop between two terminals 12, 14 running on bull-wheels 16, 18 one of which is a drive wheel. Each strand of the rope 10 forms a running track for a group 20, 22 of cars 24, 26, 28; 30, 32, 34, which run to and fro by simply reversing the rotation direction of the rope 10.

The cars 24–34 are of a standard type having a hanger arm 36 for fixing to a grip 38 fitted with sheaves 40. The grip 38 comprises a pair of jaws 42, 44 (FIG. 5) which grip the rope 10 to couple the car to the rope. A spring 46 biases the jaws 42, 44 in the gripping position and a pivoting lever 48 performs control of the jaws 42, 44 cooperating with a control rail 50, extending along the trajectory of movement of the grip in an attachment and/or detachment area of the grip 38 on the rope 10. In this area the sheaves 40 run on support rails 52, which guide and support the car detached from the rope 10. It is pointless giving a more detailed description of the constitution and operation of the grip 38, which are well known to specialists.

The terminals 12, 14 are identical and only the terminal 12 is described hereinafter. Each track of the terminal 12 has associated with it platforms 54 for unloading and/or loading passengers or materials in the cars. In the example illustrated by the figures of a group 20 of three cars 24–28, the platform 54 is sufficiently long to accommodate the three cars 24–28 at a standstill, either touching one another or a small distance apart. Each car 24–28 occupies a predetermined location, in this instance the end 56 of the platform 54 for the car 24 arriving first in the terminal, the middle part 58 for the second car 26 and the other end 60 for the last car 28. A support rail 52 supporting the grips 38 extends over the whole length of the platform 54.

The locations 56, 58 of the platform 54, which accommodate the first two cars 24, 26, are each fitted with a rail 62, 64 controlling the grips 38. The end rail 62 of the platform 54 is pivotally mounted on a fixed spindle 66 and is controlled by a jack 68, which can move the rail 62 selectively to a lowered active position, controlling the detachment lever 48 of the grip 38 of the car 24, and to a raised inactive position. The middle rail 64 in the middle part 58 of the platform 54 is articulated on the free end of the adjacent rail 62 and is controlled by a jack 70 in the same way as described above.

The rope 10 is driven by a standard motor 76 with an adjustable speed controller 78. A detector (not shown) of a car 24–28 entering the terminal controls said motor, in such a way as to almost stop the rope 10 running during the detachment operation and to re-establish the cruising speed as soon as this operation has been completed. An attachment operation also takes place at reduced speed, a programmer synchronizing the slowing down of the rope 10 and the movement of the control rail 62, 64 for attachment of the grip 38. The programmer also fixes the frequency of the departures so that the cars run a set distance apart on the rope.

Figure 6:
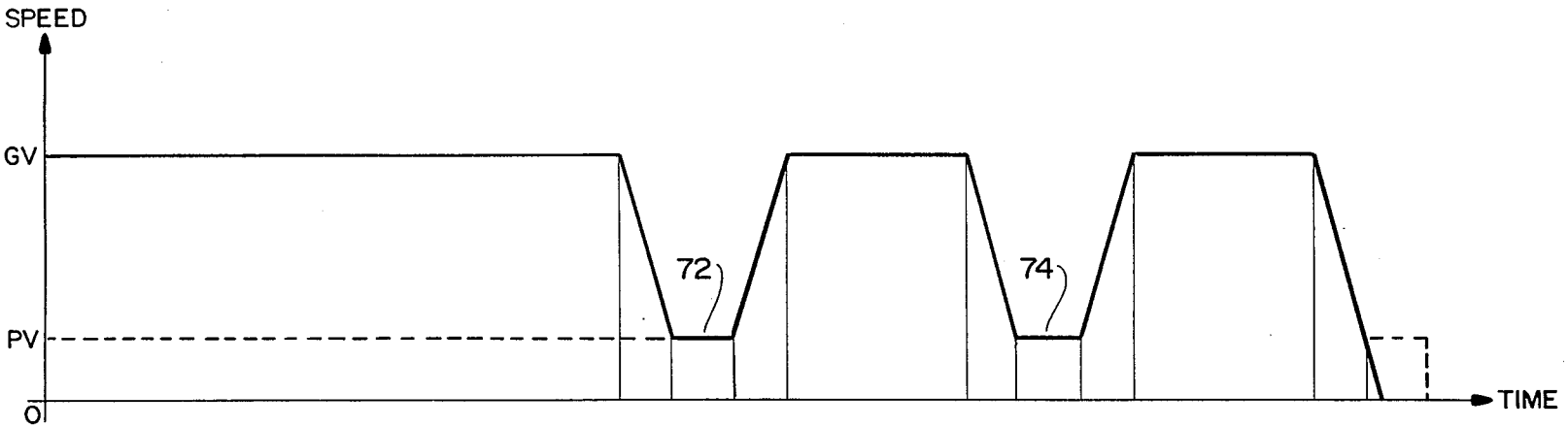
FIG. 6 is the curve of the rope speed variation in terms of time during the entry phase of a group of cars into the terminal.

The installation operates as follows:

On the line the cars 24, 26, 28 are coupled to the rope 10 a certain distance apart, for example 15 meters, in order to spread the load on the rope and to make it easier to pass the towers (FIG. 1). The cars 24, 26, 28 move in synchronism towards the terminal 12 being driven at high speed by the rope 10. The control rails 62, 64, or at least the middle rail 64, are in the raised inactive position. The detector of entry into the terminal signals the arrival of the first car 24 and orders a first slowing down 72 of the rope 10 (FIG. 6) from the great speed GV to the slow speed PV. At the same time it orders the rail 62 corresponding to the car 24 to be lowered, if this rail is not in the lowered active position. The sheaves 40 of the grip 38 are engaged on the support rail 52. When the car 24 reaches the associated location 56, the grip lever 48 is moved by the control rail 62 to the opening position of the grip 38 and the car 24 stops at this location 56, the rope 10 running between the open jaws 42, 44 of the grip 38 at the slow speed PV during detachment of the detachment of the car 24. The rope 10 is then automatically reaccelerated to the great speed GV until the arrival of the second car 26, signalled by the detector. The latter again orders slowing down 74 of the rope 10 to the slow speed PV and lowering of the associated control rail 64 to the active position to stop this car 26 at the corresponding location 58 behind the car 24. After another acceleration to the great speed GV, the rope 10 is stopped (i.e., speed is zero) on the arrival and subsequent detachment of the third and last car 28 at the corresponding location 60. It can easily be seen that the length of the platform 54 corresponds to that of the three cars 22–26, this length naturally being adapted to the number of cars in the group. At the same time as the group 20 of cars reaches the terminal 12, the group 22 reaches the opposite terminal 14, the operations being perfectly synchronized to perform the detachments during the rope slowing-down periods.

After the passengers have been unloaded and/or loaded, the installation is started up by driving the rope 10 in the opposite direction. The car 28, which becomes the first car in the group, is driven by the rope 10 to which it remains coupled, whereas the other cars 24, 26 remain temporarily in the terminal. After a predetermined time or a predetermined length of the rope 10 has run by, corresponding to the distance the cars are apart on the line, the programmer orders the rope 10 to be slowed down and the rail 64 to be raised, causing the grip 38 to close on the rope 10, which drives the car 26. The rope 10 is reaccelerated before another slowing-down takes place to couple the last car 24 to the rope 10 by raising the rail 62. When all the cars of the group are coupled to the rope 10, the latter is accelerated to move the group of cars at high speed GV towards the opposite terminal 14 where the operation described above is repeated. It is clear that attachment and detachment of the grips can be performed in a different manner, adapted to suit the type of grip used. The location 60 of the car 28 can also includes a control rail, in which case stopping of the rope 10 can be deferred, as indicated by the broken line in FIG. 6. That is, the rope can be slowed to the slow speed PV for detachment and unloading of the third car 28, after which the rope is stopped and reversed for reattachment of the cars.

When each group of cars is limited to a single car, the platform comprises a single detachment location and the cars run continuously passing from one track of the rope to the opposite track.

What I claim is:

1. An aerial ropeway transport installation having a rope extending between two terminals comprising a motor for driving said rope and a device for controlling the speed of said motor, at least a first and second vehicle each having a detachable grip for coupling the vehicles to the rope at a first set distance apart and uncoupling them in the terminals for loading and unloading with the vehicles at a standstill, a detachment area of said grips extending along the rope in the terminal, a platform constituted by said detachment area, at least first and second control means for controlling said grips located at a second set distance apart in said detachment area, said second distance being less than said first distance, said first grip control means being arranged to detach the first vehicle from the rope and the second grip control means being arranged to detach the second vehicle from the rope so that a distance between the two detached vehicles in the terminal is the same as said second set distance, said speed control device being arranged so as to almost stop the rope each time said grip control means detach a vehicle from the rope and to reaccelerate the rope after detachment has taken place.

2. An installation according to claim 1, wherein said rope is a carrier-hauling rope, each vehicle being suspended from a carriage bearing the detachable grip for coupling the vehicle to the rope, the grips being controlled by the corresponding control means each comprising a pivoting level, said carriage having sheaves able to run on a support rail extending in the detachment area in the terminals.

3. An installation according to claim 1, wherein a speed at which the rope is driven is reduced to a value lower than 1 meter per second during detachment of a grip from the rope.

4. An installation according to claim 1, wherein:

each grip control means may occupy two positons, a first position to detach the grip of the vehicle as it passes through the control means and a second retracted positon to allow the free passage of the grip attached to the rope; and said installation comprises a control device to move the grip control means selectively between said first position and said second position.

5. An installation according to claim 4, wherein each grip control means comprises a control rail, the control rails being adjacent and articulated together at their adjacent ends.

6. An installation according to claim 1, wherein said first set distance apart is greater than 10 meters and wherein the vehicles detached from the rope in the terminal contact one another.

* * * * *